US011491415B2

(12) United States Patent
Sacek et al.

(10) Patent No.: US 11,491,415 B2
(45) Date of Patent: Nov. 8, 2022

(54) CONNECTOR FOR CONSTRUCTIONS SYSTEM AND CONSTRUCTION SYSTEM

(71) Applicant: LEGO A/S, Billund (DK)

(72) Inventors: Arthur Sacek, Billund (DK); Hans Madsen, Billund (DK); Johan Dybvad Larsen, Billund (DK); Jan Hatting, Billund (DK); Pelle Normann Brix, Billund (DK)

(73) Assignee: LEGO A/S, Billund (DK)

( * ) Notice: Subject to any disclaimer, the term of this patent is extended or adjusted under 35 U.S.C. 154(b) by 0 days.

(21) Appl. No.: 17/153,585

(22) Filed: Jan. 20, 2021

(65) Prior Publication Data

US 2022/0226747 A1 Jul. 21, 2022

(51) Int. Cl.
*A63H 33/08* (2006.01)
*A63H 33/04* (2006.01)

(52) U.S. Cl.
CPC ..... *A63H 33/086* (2013.01); *A63H 33/042* (2013.01)

(58) Field of Classification Search
CPC ..... A63H 33/086; A63H 33/06
USPC ..... 446/85–128
See application file for complete search history.

(56) References Cited

U.S. PATENT DOCUMENTS 2,658,776 A * 11/1953 Wilcox ..... E04G 7/22 52/653.2
2,885,822 A * 5/1959 Onanian ..... A63H 33/101 446/121
3,005,282 A * 10/1961 Christiansen ..... A63H 33/086 446/128
3,378,219 A * 4/1968 Biesecker ..... F16B 9/056 248/231.21
3,611,609 A * 10/1971 Reijnhard ..... A63H 33/086 446/121
D276,830 S * 12/1984 Petersson ..... D21/487
(Continued)

FOREIGN PATENT DOCUMENTS

EP 0116230 A1 * 8/1994 ..... A63H 33/062
EP 007537964-0017 A1 1/2020
WO WO 2018/060917 A1 * 5/2018 ..... A63H 33/08

*Primary Examiner* — Eugene L Kim
*Assistant Examiner* — Matthew B Stanczak
(74) *Attorney, Agent, or Firm* — Day Pitney LLP; Anthony A. Kassas

(57) ABSTRACT

A connector element for a construction system, the construction system having first and second construction elements. The first type of construction elements comprising at least one construction element having connector knobs formed on a surface thereof and arranged in a regular two-dimensional lattice. The second type of construction elements comprising at least one construction element configured to cooperate with a connector peg to form a snap connection. The connector element comprising an elongate body having first and second ends and a longitudinal axis ($A_1$). The first end having a first cylindrical connector portion, having an inner surface configured to form a friction fit, and an outer surface configured to form a friction fit between four neighbouring connector knobs formed on a first type of construction element. A second cylindrical connector portion configured to form a snap connection with the cylindrical connector opening of the second type of construction elements.

15 Claims, 7 Drawing Sheets

(56) References Cited

U.S. PATENT DOCUMENTS 4,740,189 A * 4/1988 Bertrand ..... A63H 33/086 446/102
D309,927 S * 8/1990 Ryaa ..... D21/500
5,322,466 A * 6/1994 Bolli ..... A63H 33/042 24/453
5,531,625 A * 7/1996 Zhong ..... A63H 3/46 403/113
D373,153 S * 8/1996 Madsen ..... D21/487
D397,168 S * 8/1998 Poissant ..... D21/484
5,827,106 A * 10/1998 Crepeau ..... A63H 33/425 446/128
D409,259 S * 5/1999 Krog ..... D21/503
D434,812 S * 12/2000 Lehn H.o slashed.eg ... D21/487
6,461,215 B1 * 10/2002 Kunz ..... A63H 33/042 446/102
6,547,624 B1 * 4/2003 Bojesen ..... A63H 33/086 446/85
6,561,866 B1 * 5/2003 Lee ..... A63H 33/042 446/103
6,736,691 B1 * 5/2004 Bach ..... A63H 33/101 446/116
D583,880 S * 12/2008 Slater ..... D21/487
7,666,054 B2 * 2/2010 Glickman ..... A63H 33/082 446/124
7,780,499 B1 * 8/2010 Truckai ..... B43K 29/00 446/73
7,942,717 B2 * 5/2011 Chou ..... G06T 19/20 446/91
8,986,012 B1 * 3/2015 McGee ..... A63H 33/08 434/211
9,044,690 B2 * 6/2015 Uttley ..... A63H 33/102
9,498,703 B2 * 11/2016 McCoskey ..... A63F 9/12
9,814,288 B2 * 11/2017 Kim ..... A45C 11/00
9,814,997 B1 * 11/2017 Vaillancourt ..... A63H 33/086
9,839,860 B2 * 12/2017 Rakhsha ..... A63H 33/04
9,841,180 B1 * 12/2017 Lin ..... H05K 1/181
10,143,931 B2 * 12/2018 Wang ..... A63H 33/108
10,561,958 B2 * 2/2020 Purwar ..... A63H 33/101
10,905,966 B2 * 2/2021 Sisamos ..... A63H 33/062
2006/0276100 A1 * 12/2006 Glickman ..... A63H 33/086 446/120
2007/0123137 A1 * 5/2007 Marzetta ..... A63H 33/105 446/120
2007/0277459 A1 * 12/2007 Marzetta ..... A63H 33/101 52/281
2008/0214087 A1 * 9/2008 Warner ..... A63H 33/102 446/124
2008/0220690 A1 * 9/2008 Munch ..... A63H 33/042 446/128
2009/0017716 A1 * 1/2009 Marzetta ..... A63H 33/108 446/128
2009/0305602 A1 * 12/2009 Gaute ..... A63H 33/042 446/91
2011/0039474 A1 * 2/2011 Bruder ..... A63H 33/101 446/124
2011/0045733 A1 * 2/2011 Saigo ..... A63H 33/086 446/125
2013/0122776 A1 * 5/2013 Gabai ..... A63H 33/00 446/104
2013/0203315 A1 * 8/2013 Scanzon ..... A63H 33/088 446/75
2013/0217296 A1 * 8/2013 Widjaja ..... A63H 33/101 446/124
2013/0330999 A1 * 12/2013 Ryaa ..... A63H 33/086 446/124
2014/0045403 A1 * 2/2014 Murphy ..... A63H 33/101 446/124
2014/0227936 A1 * 8/2014 Botterill ..... A63H 33/062 446/99
2014/0241791 A1 * 8/2014 Kim ..... F16B 19/1081 403/274
2014/0273712 A1 * 9/2014 Uttley ..... A63H 33/107 446/121
2015/0004871 A1 * 1/2015 Laursen ..... A63H 33/08 446/124
2015/0202542 A1 * 7/2015 Sze ..... A63H 33/042 446/90
2015/0258463 A1 * 9/2015 Park ..... A63H 33/106 446/124
2016/0339351 A1 * 11/2016 Akishbekov ..... A63H 33/042
2020/0188806 A1 * 6/2020 Desforges ..... A63H 3/16
2020/0222821 A1 * 7/2020 Lange ..... A63H 33/088
2020/0330893 A1 * 10/2020 Jensen ..... A63H 33/086
2020/0360830 A1 * 11/2020 Molgaard ..... A63H 18/02
2021/0038972 A1 * 2/2021 Lin ..... A63F 9/0613
2021/0059063 A1 * 2/2021 Hong ..... A63H 33/042

* cited by examiner

CONNECTOR FOR CONSTRUCTIONS SYSTEM AND CONSTRUCTION SYSTEM

The present invention relates to a connector element for a releasably connecting a first type construction elements to a second type of construction elements. The invention also relates to a construction system comprising construction elements of a first type, construction elements of a second type and a connector for releasably connecting of the first type construction elements to the second type construction elements.

BACKGROUND OF THE INVENTION

Learning systems, robotics construction sets, and so-called maker kits are known, which can provide a user with a variety of functionalities, which, however, represent limited construction sets for a limited number of given projects, or which are very complicated and therefore only accessible to advanced users, and in the long run interesting as well as insightful.

These issues are partially solved by modular construction systems with enhanced functionality, namely by a combination of simple modular construction elements as they are known from traditional modular construction systems, such as beams, plates, bricks, pegs, connectors, cog-wheels, etc., with functional modular construction elements, such as lighting elements, motors/actuators, sensors, but also programmable processor units, which may also be digitally connectable with external devices, e.g. for programming or remote control. Such modular construction systems with enhanced functionality have proven their value in a play context, as well as in learning environments, not the least because they facilitate reliable, yet easily detachable mechanical connections between simple and functional modular construction elements, and because the functional modular construction elements are adapted to each other to provide a positive and stimulating user experience.

However, in some cases it may also be desirable in a play or educational context to use the functionality of external components, such as from a maker-kit, in combination with modular construction elements. Therefore, there is a need for combining components of different types of modular construction elements in a simple manner.

More particularly it is an object of the invention to allow for a close, space reducing connection between a first type construction element of a type comprising construction elements having connector knobs formed on a surface thereof, the connector knobs being arranged in a regular two-dimensional lattice with a second type of construction element, comprising a connector opening configured for cooperating with a connector peg to form a snap connection.

SUMMARY OF THE INVENTION

These and other objects are—in a first aspect of the invention achieved by a connector element for a construction system, the construction system comprising a first type of construction elements; and a second type of construction elements;

the first type of construction elements comprising at least one construction element having connector knobs formed on a surface thereof, the connector knobs being arranged in a regular two-dimensional lattice, the second type of construction elements comprising at least one construction element comprising a cylindrical connector opening configured for cooperating with a connector peg to form a snap connection, and wherein the connector element comprises an elongate body having a first end and an opposite, second end and a longitudinal axis, wherein a first cylindrical connector portion is formed at the first end of the connector element, the first cylindrical connector portion having an inner surface and an outer surface, wherein the inner surface is dimensioned such that it may form a friction fit, when pressed over a connector knob formed on a first type construction element, wherein the outer surface of the first cylindrical connector portion is dimensioned such that it may form a friction fit between four neighbouring connector knobs formed on a first type construction element, and wherein a second cylindrical connector portion is formed at the second end of the connector element, the second cylindrical connector portion being configured to form a snap connection with the cylindrical connector opening of the second type of construction elements.

A friction fit may also be called an interference fit or press fit. A friction fit, in general, is a form of fastening between two tight fitting mating parts that produces a joint which is held together by friction after the parts are pushed together. Sometimes such a connection is also referred to as a clutch. Clutch refers to a static hold. Although "friction" indicates a movement, which is correct as you mount the element but when mounted you would not then have friction, until the element is attempted moved again.

The snap connection may be provided by providing the second cylindrical connector portion with a circumferential bead formed at the extreme of the second end of the second cylindrical connector portion.

In an embodiment, the second cylindrical connector portion of the connector element comprises a slit arranged in the longitudinal direction of the connector element. Thereby the second cylindrical connector portion may in an uncomplicated manner be provided with a resilience allowing the second cylindrical connector portion to snap into connection with the cylindrical connector opening of the second type of construction elements.

In one embodiment, the outer surface of the first cylindrical connector portion of the connector element comprises four indentations, equidistantly spaced along a perimeter of the outer surface, each of the four indentations being configured to receive a portion of four neighbouring connector knobs formed on a first type construction element.

However, in an alternative, preferred embodiment, a diameter of the outer surface of the first cylindrical connector portion of the connector element is equal to a smallest diagonal distance between the outer surfaces of two neighbouring connector knobs in the regular $n \times m$, $n \geq 2$, $m \geq 2$, lattice of a first type construction element.

In a further embodiment of any of the previously mentioned embodiments of the connector element a length of the inner surface of the first cylindrical connector portion of the connector element is equal to a height of the connector knobs formed on a first type construction element. Thereby, detachment of a connector element connected over a knob is made easier, while aiding the stability of the connection during the connection.

In a further embodiment of any of the previously mentioned embodiments, the connector element comprises an intermediary portion formed between the first cylindrical connector portion and the second cylindrical connector portion. In a preferred embodiment hereof, the intermediary portion comprises elongate second indentations formed in an outer surface of the intermediary portion and perpendicularly to the longitudinal axis of the connector element. The elongate second indentations allows removal of the connector element from its connection over a connector knob or between four neighbouring connector knobs in an easy manner, and the elongate second indentations being formed in the intermediary portion allows the arrangement of the elongate second indentations without loss of structural strength of the connector element. In another embodiment thereof, a length the outer surface of the first cylindrical portion is smaller than a height of a connector knob formed on a first type construction element. This allows a very compact connection of a first type construction element and a second type construction element.

In a further embodiment of any of the previously mentioned embodiments, the length of the second cylindrical connector portion of the connector element is equal to the length of the cylindrical connector opening of the second type of construction elements.

The object are—in a second aspect of the invention—obtained by a construction system comprising

- a first type of construction elements; and
- a second type of construction elements;
- the first type of construction elements comprising connector knobs formed on a surface thereof, the connector knobs being arranged in a regular two-dimensional lattice, and
- the second type of construction elements comprising connector openings,
- where the construction system further comprises a connector element according to any one of the embodiments of the first aspect of the invention, as referred above.

In an embodiment of the first aspect of the invention the construction system comprises an electrical motor having a box shaped housing and a power outtake part formed in one surface of the box shaped housing, and three or more connector holes provided on a second surface, which surface is different from the surface comprising the power outtake part of the electrical motor, and where each of the three or more connector holes are provided in positons on the second surface at distances from each other corresponding to positions of lattice positions of the regular two-dimensional lattice of a first type of construction elements.

In a further embodiment, the electrical motor comprises four connector holes provided on the second surface, the four connector holes being arranged in a rectangular pattern of the second surface.

It should be emphasized that the term "comprises/comprising/comprised of" when used in this specification is taken to specify the presence of stated features, integers, steps or components but does not preclude the presence or addition of one or more other features, integers, steps, components or groups thereof.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

Figure 1A:
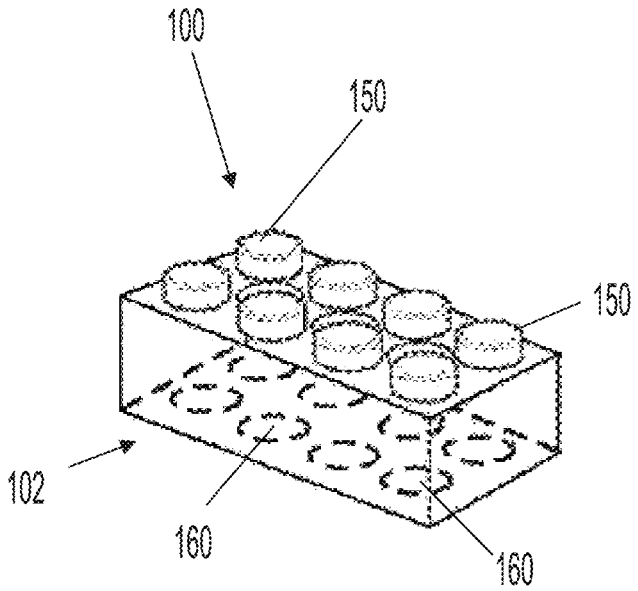
Fig. 1A Prior Art
FIG. 1A, in a see-through perspective view, shows a prior art construction element belonging to a first type of construction elements, the construction element having connector knobs formed on one surface and connector knob receiving openings on an opposite surface.

FIG. 1A illustrates, in a see-through perspective view, a prior art construction element 102 belonging to a first type of construction elements 100. Such first type of construction elements 100 comprises at least connector knobs 150 configured for connecting to similar but variously shaped other construction elements having knob receiving openings 160. The construction element 102 shown in FIG. 1A has connector knobs 150 formed on an upper surface thereof and knob receiving openings 160 formed in an opposite surface thereof. It will be appreciated that for example two construction elements 102 as shown in FIG. 1A may be connected to each other by connecting the connector knobs 150 of one construction element 102 to a corresponding number of connector openings 160 of a second construction element 102. The connector knobs 150 and the knob receiving openings 160 form friction fits/friction connections by an outer diameter of the cylindrical connector knobs 150 being closely adapted to the dimensioning of one or more surfaces of the knob receiving openings 160.

The construction element 102 shown in FIG. 1A has eight connector knobs 150 and eight knob receiving openings 160. The connector knobs 150 are arranged in a regular two-dimensional lattice, in this case a 2×4 lattice. Similarly, the knob receiving openings 160 are arranged in a regular two-dimensional lattice, in this case a 2×4 lattice. The construction element 102 shown in FIG. 1A is shaped as a brick.

Figure 1B:
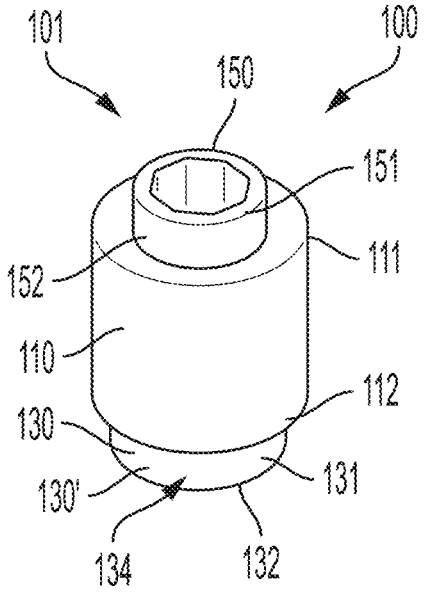
Fig. 1B Prior Art
FIG. 1B, in a perspective view, shows a prior art construction element, also belonging to a first type of construction elements, the construction element having one end configured for connecting to a construction element having one or more connector knobs such as the construction element shown in FIG. 1A or 1C, and an opposite end having a connector knob configured for connecting to a construction element having one or more knob receiving openings.
Figure 1C:
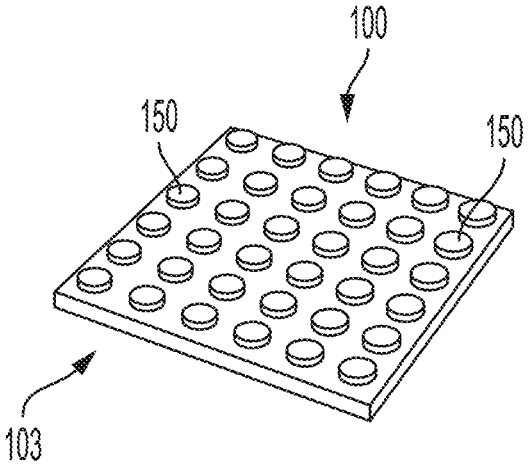
Fig. 1C Prior Art
FIG. 1C, in a perspective view, shows another example of a prior art construction element belonging to a first type of construction elements, the construction element having connector knobs formed on one surface and connector knob receiving openings on an opposite surface FIG. 2A, in a perspective view, shows a prior art connector element for a different kind of construction system comprising a second type construction elements, the second type construction elements comprising connector openings, the connector element having two opposed ends, each of which comprising a snap connection configured for connecting to a connector opening of second type construction element.

Other types of first type construction elements 100 are shown in FIGS. 1B and 1C. The construction element 101 shown in FIG. 1B is formed with a single connector knob 150, and has a general cylindrical shape. The construction element 103 shown in FIG. 1C is formed as a plate. The plate-shaped construction element in FIG. 1C comprises 36 connector knobs 150 formed in a 6×6 lattice, and 36 knob receiving openings knobs 160 (not shown), also arranged in a 6×6 lattice, on the opposite side of the connector knobs 150.

Construction elements of the first type construction elements 100 are herein defined as having either connector knobs or knob receiving openings 160 or both. A first type construction system 1000 is herein defined as a system of construction elements comprising two or more first type construction elements 100, where at least one construction element has connector knobs 150 arranged in a regular two-dimensional n×m lattice, where n≥1; m≥1. An example of a first type construction system 1000 is known in the art, e.g. under the trade name LEGO SYSTEM©, marketed by LEGO A/S.

FIG. 1B illustrates an example of a prior art construction element 101 configured to be connected to other construction elements 101, 102, 103 of a first type construction system 1000, where connection of variously shaped construction elements 101, 102, 103 are based on the construction elements having either connector knobs 150 formed in a lattice arrangement or knob-receiving openings 160 or both. The connector knobs 150 and the knob-receiving openings 160 are configured to be connected via a frictional fit.

The illustrated prior art construction element 101 of FIG. 1B comprises a generally cylindrical body 110 having a first end 111, an opposite second end 112 and a longitudinal axis.

At the first end 111 of the cylindrical body 110, the prior art construction element 101 comprises a single connector knob 150. The single connector knob 150 is generally cylindrical, with a smaller diameter than the cylindrical body 110 of the construction element 101. The single connector knob 150 has a first end 151, a second end 152 and a longitudinal axis. The longitudinal axis of the single connector knob coincides with the longitudinal axis of the cylindrical body 110 of the prior art construction element 101. The second end 152 of the single connector knob 150 is connected to the first end 111 of the cylindrical body 110 of the prior art construction element 101. The single connector knob 150 extends from the first end 111 of the cylindrical body 110 of the prior art construction element 101.

The single connector knob 150 is dimensioned such that it may fit into a knob-receiving opening 160 formed in another construction element 101, 102, 103 of the first type construction system 1000.

At the second end 112 of the cylindrical body portion 110, the prior art construction element 101 shown in FIG. 1, comprises a cylindrical connector portion 130.

The cylindrical connector portion 130 comprises a cylindrical wall 130' having a first end 131, a second end 132 and a longitudinal axis. The longitudinal axis of the cylindrical wall 130' of the cylindrical connector portion 130 coincides with the longitudinal axis of the cylindrical body 110 of the prior art construction element 101.

The first end 131 of the cylindrical wall 130' of the cylindrical connector portion 130 is connected to the second end 112 of the cylindrical body 110 of the prior art construction element 101. The cylindrical wall 130' of the cylindrical connector portion 130 extends from the second end 112 of the cylindrical body 110 of the prior art construction element 101.

The cylindrical wall 130' of the cylindrical connector portion 130 comprises an inner surface 133 and an outer surface 134.

The inner surface 133 is dimensioned such that it may form a friction fit, when pressed over a connector knob 150 formed on a first type construction element 100. Thus, the inner surface 133 provides an example of the above mentioned knob-receiving openings.

The outer surface 134 is dimensioned such that it may form a friction fit between four neighbouring connector knobs 150 formed on another first type construction element 100 for example on a brick shaped construction element 101, shown in FIG. 1A or a plate-shaped construction element 103.

Figure 2A:
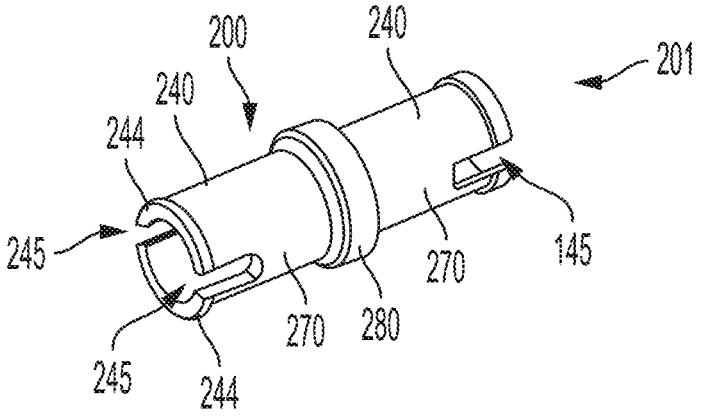
Fig. 2A Prior Art
FIG. 2B, in a perspective view, shows two prior art connector elements as in FIG. 2A inserted into connector opening of one construction element of a construction system, and another construction element of the construction system having further connector openings.

FIG. 2A shows a different type of prior art construction element 201 configured to be connected to other construction elements 202, 203, 204 of a second type construction system 2000, where connection of variously shaped construction elements 201, 202, 203, 204 are based on the construction elements 201, 202, 203, 204 having cooperating connection means configured for making snap-connections, and where the connection means comprises cylindrical connector openings 250 and cooperating resilient connector pegs 270 in the form of cylindrical connector portions 240.

Figure 2B:
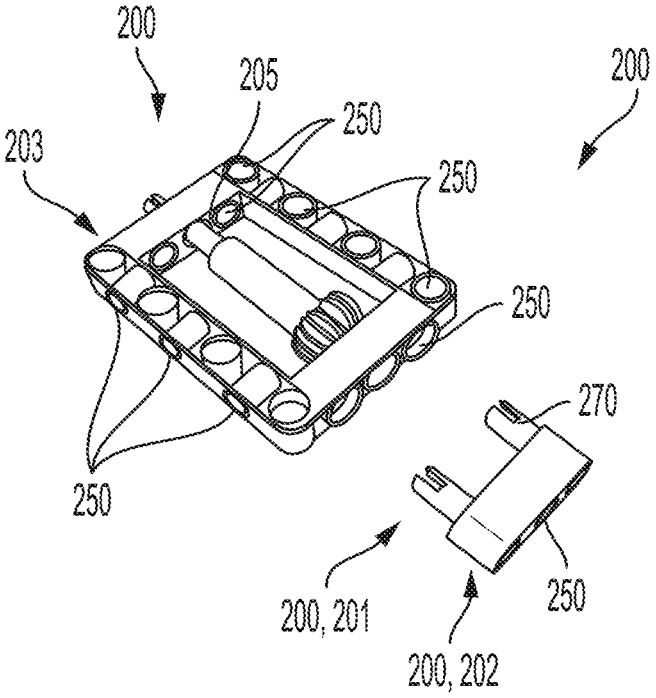
Fig. 2B Prior Art
Figure 5:
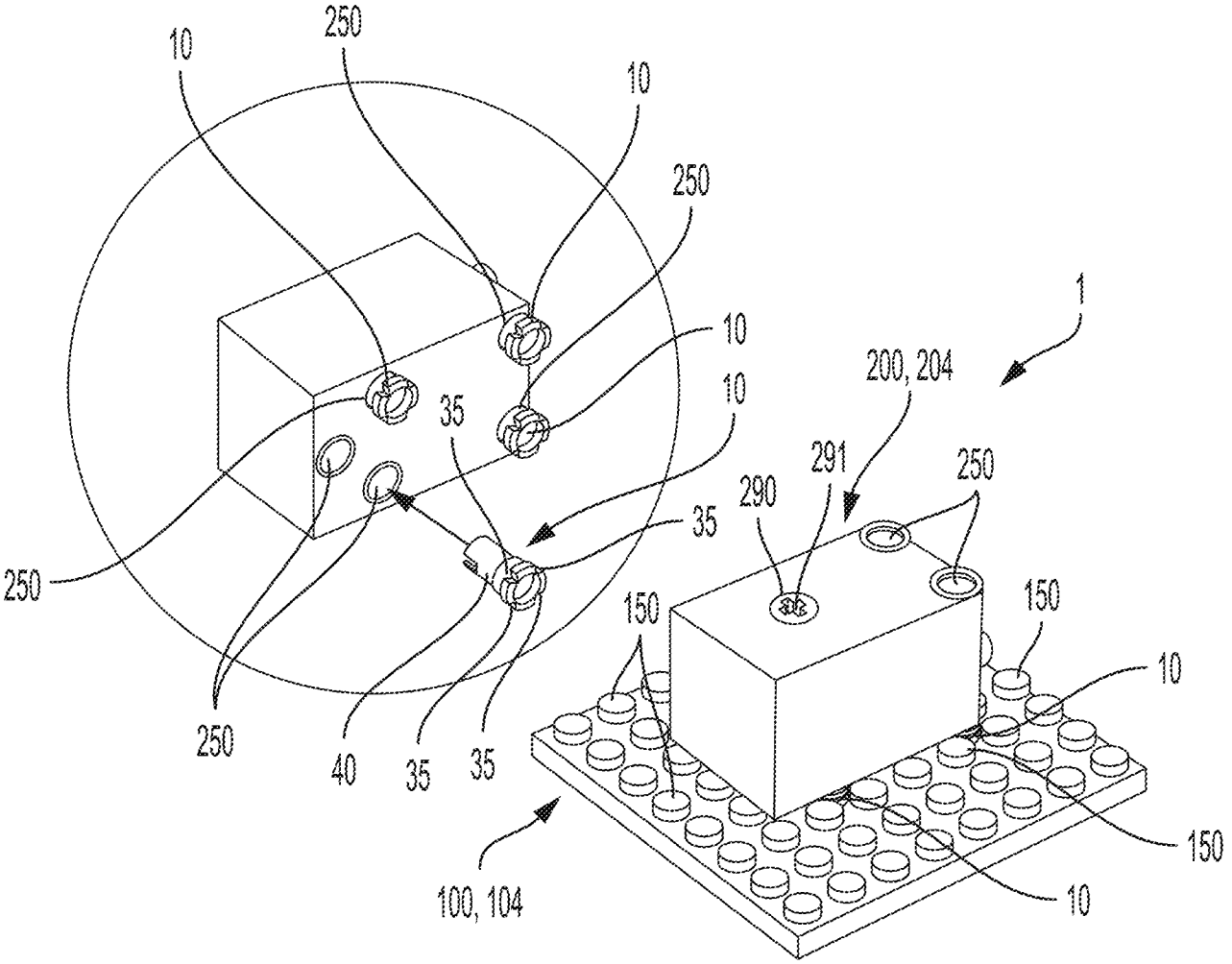
FIG. 5, in a perspective view, shows mounting of a connector element according to the invention to a connector openings of a first construction element of a construction system, and the first construction element mounted on a second construction element via a set of connector elements.
Figure 7B:
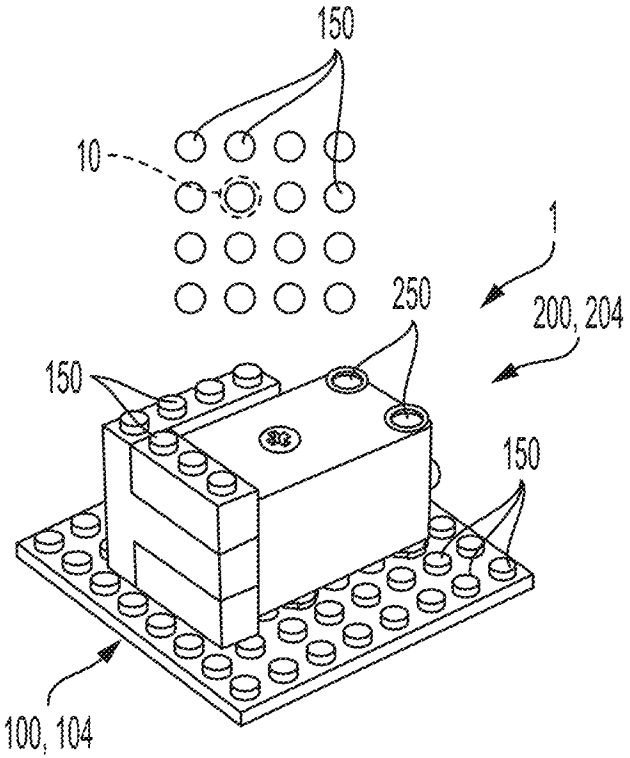
FIG. 7B illustrates a second construction element having knobs formed in a regular lattice arrangement with further construction elements mounted thereto, and a first construction element mounted to the second construction element in a second position relative to the knobs.
Figure 7A:
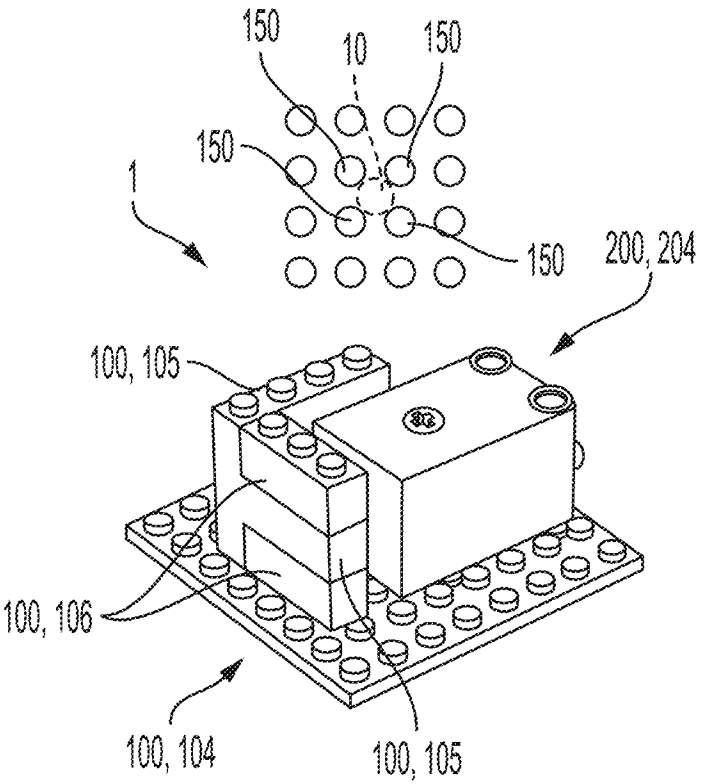
FIG. 7A illustrates a second construction element having knobs formed in a regular lattice arrangement with further construction elements mounted thereto, and a first construction element mounted to the second construction element in a first position relative to the knobs.

FIG. 2A shows a second type construction element 200, 201 having two cylindrical connector portions 240 formed along a common axis and facing away from each other. FIG. 2B shows an example of a second type construction system 2000 comprising second type construction elements 200, 201, 202, 203 having various shapes and forms and various connection means. FIGS. 5 and 7A-7B, shows yet another second type construction element 200, 204, in the form of a electric motor and having cylindrical connector openings 250 configured for cooperating with other second type construction elements 200 having protruding cylindrical connector portions 240, such as e.g. a second type construction element 201 as shown in FIG. 2A.

The second type construction element 200, 201 shown in FIG. 2A comprises two resilient connector pegs 270 in the form of two cylindrical connector portion 240 each being configured to form a snap connection with a connector opening 250 formed on another second type of construction element 200.

FIG. 2B shows two other second type construction elements 200, 202, 203.

The second type construction element 202, shown to the right in the figure, is shaped as a beam having three cylindrical connector openings 250 formed there through. In two of these cylindrical connector openings 250 one end of a second type construction element 201 as shown in FIG. 2A has been inserted and has been releasably locked thereto in a snap connection. The second type construction element 203, shown to the left in the figure, is shaped as a rectangular frame formed by four beams formed in a common plane.

Two of these beams have three connector openings 250 formed with longitudinal axes parallel to the plane of the frame. It will be appreciated that each of these connector openings 250 may receive a cylindrical connector portion 240 of a second type construction element 201 as shown in FIG. 2A. However, it will also be appreciated that the connector openings may also form a bearing for e.g. an axle 205 as also shown in FIG. 2B.

The two beams of the frame-shaped second type construction element 203 in FIG. 2B, which are formed perpendicularly to the above mentioned two beams, each have three cylindrical connector openings 250 formed there through in the plane of the frame and four cylindrical connector openings 250 formed through the beam with longitudinal axes perpendicular to the plane of the frame. Again, it will be appreciated that each of these connector openings 250 may receive a cylindrical connector portion 240 of a second type construction element 201 as shown in FIG. 2A.

The second type construction element 200, 201 shown in FIG. 2A comprising two opposed cylindrical connector portions 240 may be used to releasably connect two second type construction elements 200, such as second type construction elements 202, 204, shown in FIG. 2B. In not shown variants, second type construction elements 200 may comprise both one or more cylindrical connector openings 250 and one or more cylindrical connector portions 240.

The snap connection between a cylindrical connector portion 240 and a cylindrical connector opening 250 is provided by the cylindrical connector portion 240 being provided with a circumferentially arranged bead 244 arranged at the free end of the cylindrical connector portion 240, and by a resilience of the cylindrical connector portion 240. This resilience may be provided by one or more slits 245 formed in the longitudinal direction of the cylindrical connector portion 240. In the FIG. 2A variant two such slits 245 are shown. The diameter of the bead 244 is slightly larger than the diameter of the main body of the cylindrical connector portion 240.

A length of the cylindrical connector portion 240 corresponds to a length of the cylindrical connector openings 250. A diameter of the cylindrical connector portion 240 corresponds to a dimeter of the cylindrical connector openings 250.

Each end of the cylindrical connector openings 250 is provided with an enlarged diameter ring-shaped opening (not shown) configured to cooperate with the bead 244 formed on the cylindrical connector portion 240.

When a cylindrical connector portion 240 is pressed through a cylindrical connector openings 250 by a user, the resilience of the cylindrical connector portion 240 allows the bead 244 to be pressed through the main portion of the cylindrical connector opening 250, and when the bead reaches the enlarged diameter ring-shaped opening at the opposite end of the cylindrical connector opening 250, the resilience of the main body of the cylindrical connector portion 240 allows the bead 244 to engage with the enlarged diameter ring-shaped opening, thereby forming a snap connection between the cylindrical connector portion 240 and the cylindrical connector opening 250.

Such snap connections are known in the art.

Construction elements of the second type construction elements 200 are herein defined as having at least cylindrical connector opening 250 configured for making snap connections with cylindrical connecter portions 240 (resilient connector pegs 270) as explained above. Second type construction elements 200, may also comprise construction elements having one or more cylindrical connecter portions 240. Second type construction elements 200, may also comprise construction elements having one or more cylindrical connecter portions 240 and one or more cylindrical connector opening 250.

A second type construction system 2000 is herein defined as a system of construction elements comprising two or more second type construction elements 200, where at least one construction element at least one connector opening 250. An example of a second type construction system 2000 is known in the art, e.g. under the trade name LEGO TECHNIC©, marketed by LEGO A/S.

It will be appreciated that some second type construction elements 200 and some construction elements of a second type construction system 2000 may additionally have connector knobs 150 or knob receiving openings 160 or both.

Figure 3:
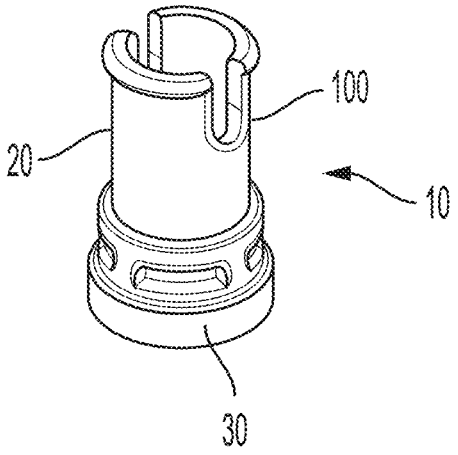
FIG. 3, in a perspective view, shows a connector element according to the invention.

FIG. 3, in a perspective view, shows a connector element 10 according to the invention. The connector element 10 is configured for connecting construction elements belonging to a first type of construction elements 100 and construction elements, belonging to a second type of construction elements 200 as defined above. One or more connector element (s) 10 may further form part of a construction system 1 further comprising one or more first type of construction elements 100 and one or more second type of construction elements 200.

Figure 8:
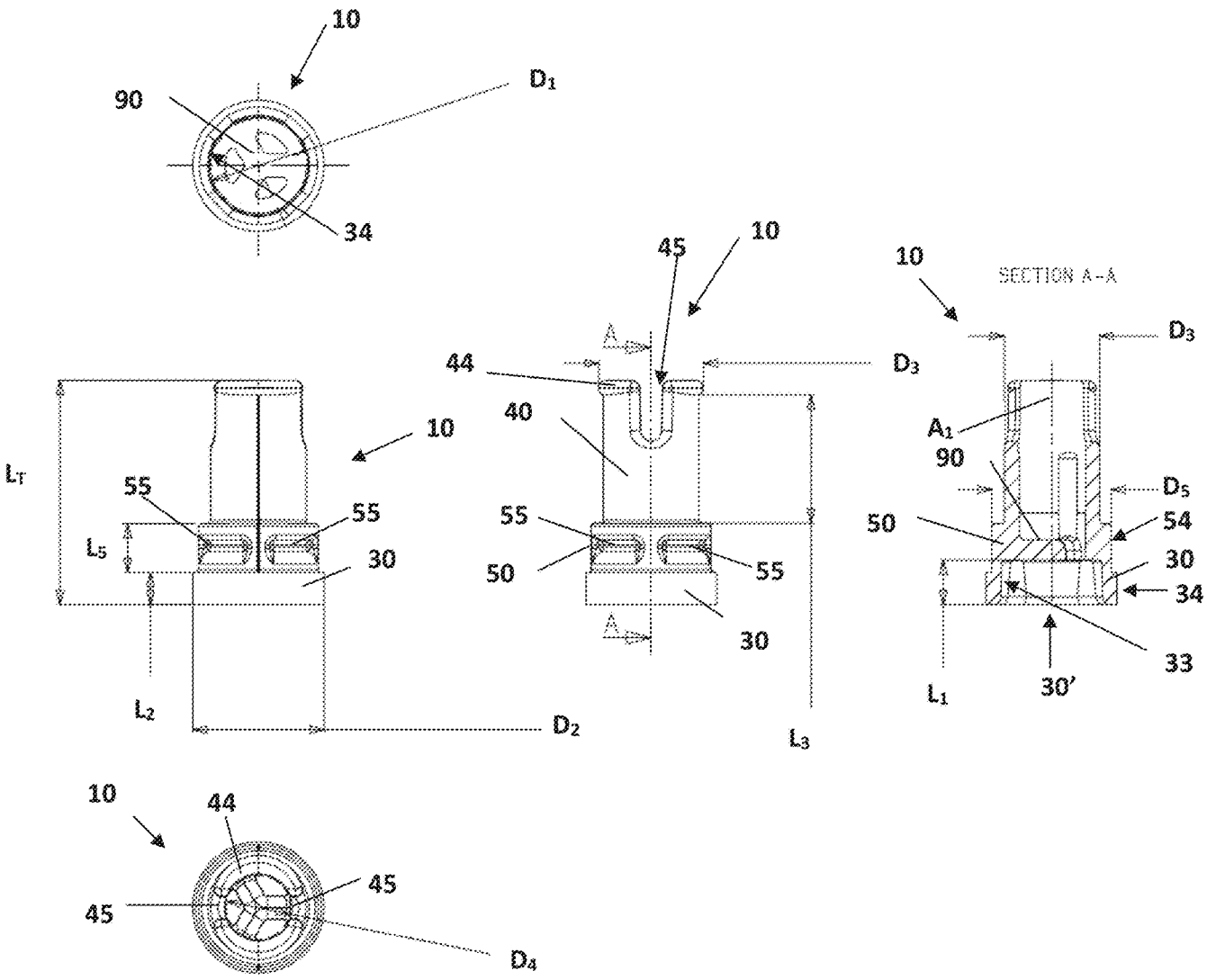
FIG. 8 shows as bottom view, a first side view, a second side view, a top view and a sectional side view of a connector element according to an embodiment of the invention taken along section A-A of the second side view.

The connector element 10 comprises an elongate body 20 having a first end 21 and an opposite, second end 22 and a longitudinal axis $A_1$ (see also FIG. 8). The elongate body comprises a first cylindrical connector portion 30, which is formed at the first end 21, and a second cylindrical connector portion 40, which is formed at the second end 22 of the connector element 10. The first cylindrical connector portion 30 and the second cylindrical connector portion 40 are formed coaxially in extension of each other along the longitudinal axis $A_1$.

As shown, in some embodiments, the connector element 10 may further comprise an intermediary portion 50, formed between the first cylindrical connector portion 30 and the second cylindrical connector portion 40. The first cylindrical connector portion 30, the second cylindrical connector portion 40, and the intermediary portion 50 are formed coaxially in extension of each other along the longitudinal axis $A_1$.

The first cylindrical connector portion 30 is shaped as a cylindrical tubular member comprising an inner surface 33 (or "inwardly facing surface", or "internal surface") and an outer surface 34 (or "outwardly facing surface", or "external surface"). The inner surface 33 and the outer surface may be seen in the sectional view in the rightmost depiction of FIG. 8.

The inner surface 33 is dimensioned such that it may form a friction fit, when pressed over a connector knob 150 formed on a first type construction element 100.

This may be obtained by the inner surface 33 of the first cylindrical connector portion 30 being shaped and dimensioned to cooperate exactly with the shape and dimensions of a knob 150.

Preferably, the inner surface 33 of the first cylindrical connector portion 30 is cylindrical having a diameter $D_1$, see the upper left hand depiction in FIG. 8.

Preferably, the diameter $D_1$ of the inner surface 33 is identical to the outer diameter of cylindrical outer surface of a connector knob 150.

Figure 6:
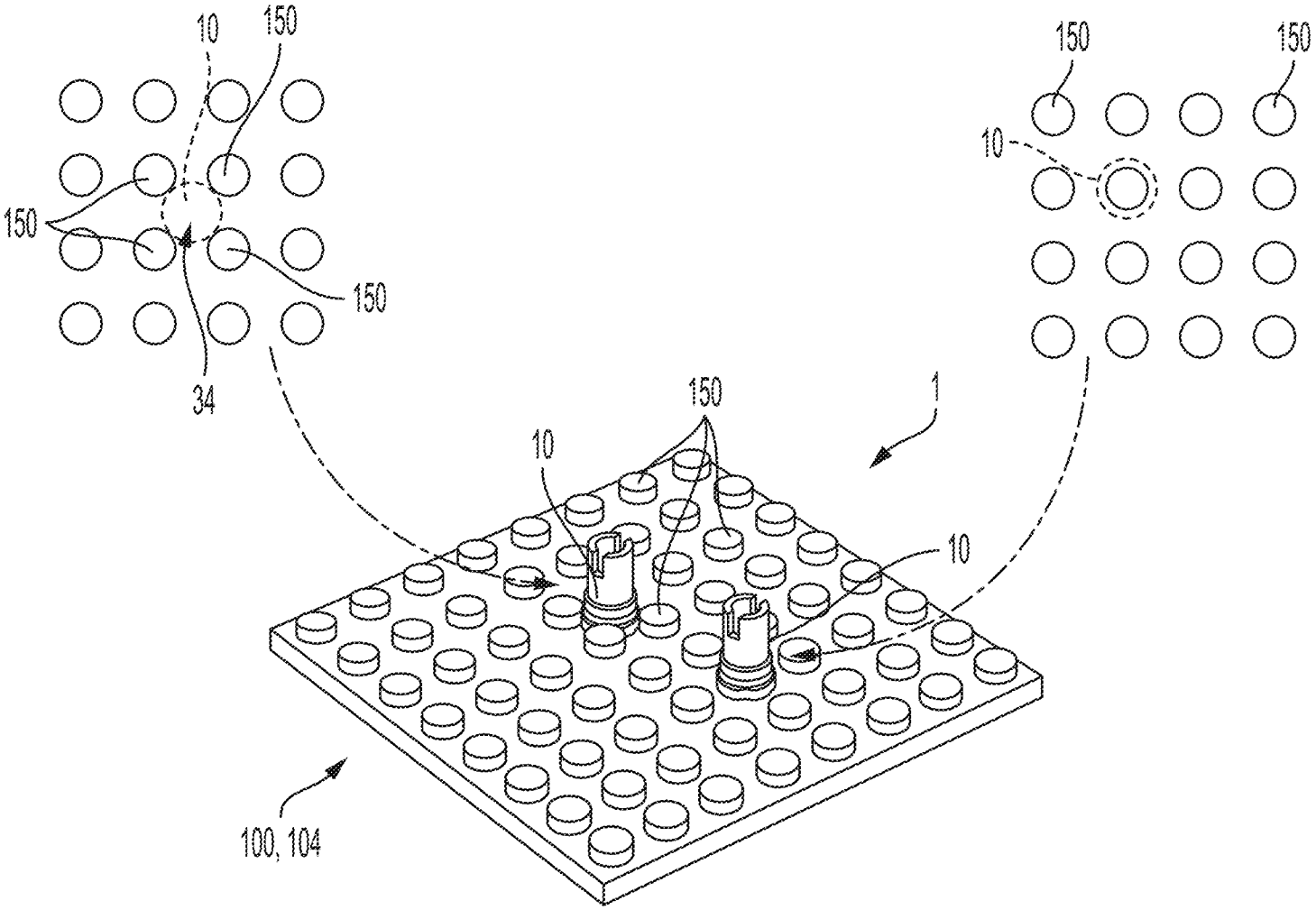
FIG. 6 illustrates a second construction element having knobs formed in a regular lattice arrangement and two identical first connector elements according to the invention mounted to the second construction element in two different ways.

FIG. 6 shows a plate-shaped first type construction element 100, 103 having two connector elements 10 connected thereto. In the right side of the figure one connector element 10 is shown to be connected in a friction fit over knob 150 between the cylindrical outer surface of a connector knob 150 and the cylindrical inner surface 33 of the first cylindrical connector portion 30 of the connector element 10.

The outer surface 34 is dimensioned such that it may form a friction fit between four neighbouring connector knobs 150 formed on a first type construction element 100.

This may be obtained by the outer surface 34 of the first cylindrical connector portion 30 being shaped and dimensioned to cooperate exactly with the shape and dimensions of the space between four neighbouring knobs 150 in the regular n×m, n≥2, m≥2 lattice of a first type construction element 100.

In one embodiment, and as shown in FIGS. 3, 4, 6, 7A, 7B and 8, the outer surface 34 of the first cylindrical connector portion 30 is cylindrical having a diameter $D_2$, see e.g. the central left hand depiction in FIG. 8. In this case, preferably, the diameter $D_2$ of the outer surface 34 is identical to a smallest diagonal distance between the outer surfaces of two neighbouring connector knobs 150 in the regular n×m, n≥2, m≥2, lattice of a first type construction element 100.

As mentioned above, FIG. 6 shows a plate-shaped first type construction element 100, 103 having two connector elements 10 connected thereto. In the left side of the figure one connector element 10 is shown to be connected in a friction fit between four connector knobs 150, i.e. between a portion of the cylindrical outer surface of each of the four connector knobs 150 and the cylindrical outer surface 34 of the first cylindrical connector portion 30 of the connector element 10.

In FIG. 5 a slightly different embodiment of the connector element 10 is shown. The connector element 10 in FIG. 5 is generally identical to the connector element 10 shown in FIGS. 3, 4, 6, 7A, 7B, and 8, including in features described below, except the shape and dimensioning of the outer surface 34 of the of the first cylindrical connector portion 30 of the connector element 10. As best appreciated by the insert detail of FIG. 5, the outer surface 34 in this embodiment has a general diameter, which is larger than the smallest diagonal distance between the outer surfaces of two neighbouring connector knobs 150 in the regular n×m, n≥2, m≥2, lattice of a first type construction element 100. In order to allow a friction fit between the outer surface 34 and four knobs 150, in this embodiment, the outer surface 34 of the first cylindrical connector portion 30 of the connector element 10 is provided with four indentations 35 formed in the outer surface of the first cylindrical connector portion of the connector element. The four indentations 35 preferably each forms an arc of a circle with a diameter of a knob, i.e. the same a $D_1$. The four indentations 35 are preferably formed equidistantly along a perimeter of the outer surface 34 of the first cylindrical connector portion 30 of the connector element 10. The right hand side of FIG. 5 shows how a second type construction element 200 in the form of an electrical motor 204 having cylindrical connector openings 250 can be connected to a first type construction element 104. The first type construction element 100, 104 shown in FIG. 5 is formed as a plate. The plate-shaped construction element 104 in FIG. 5 comprises 64 connector knobs 150 formed in an 8×8 lattice, and 64 knob-receiving openings 160 (not shown), also arranged in a 8×8 lattice on the opposite side of the connector knobs 150. The electrical motor 204 is connected to the plate 104 via four connecter elements 10, each of which has its second cylindrical connector portion 40 inserted into a cylindrical connector openings 250 on the electrical motor 204, and it's oppositely arranged first cylindrical connector portion 30 connected between four neighbouring connector knobs 150 on the plate 104.

In either of the previously described embodiments, the second cylindrical connector portion 40, formed at the second end 22 of the connector element (10) is configured to form a snap connection with a cylindrical connector opening 250 of the second type of construction elements 200.

For this purpose, the second cylindrical connector portion 40 is preferably shaped as cylindrical connecter portion 240 (resilient connector peg 270) as described above. The second cylindrical connector portion 40 is configured to be connected to construction elements 202, 203, 204 of a second type construction system 200, where connection of variously shaped construction elements 201, 202, 203, 204 are based on the construction elements 201, 202, 203, 204 having cooperating connection means configured for making snap-connections, and where the connection means comprises cylindrical connector openings 250 and cooperating resilient connector pegs 270 in the form of cylindrical connector portions 240.

Figure 4:
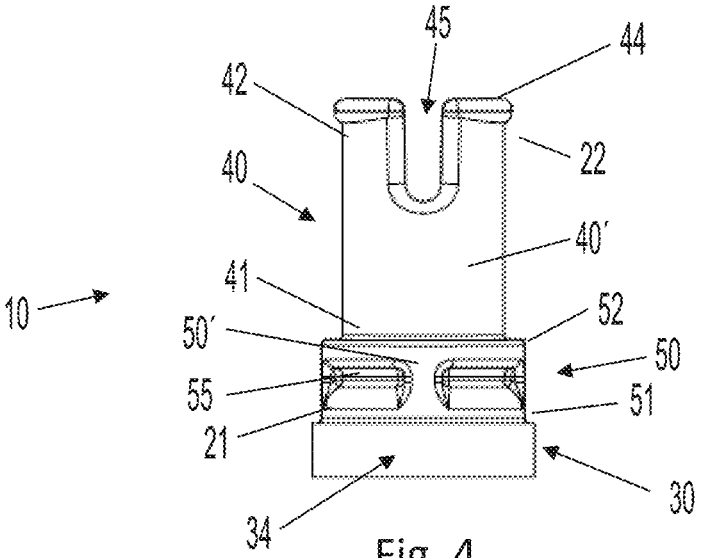
FIG. 4, in a side view, shows the connector element

The second cylindrical connector portion 40 as shown in e.g. FIG. 4 comprises a first end 41 and a second end 42 and an elongate body 40' extending there between. The elongate body 40' is cylindrical having an elongate axis identical to the elongate of the longitudinal axis $A_1$ of the connector element 10 (see FIG. 8). The elongate body 40' has a diameter, $D_3$, see FIG. 8 The diameter $D_3$ of the elongate body 40 is smaller than the outer diameter $D_2$ of the first cylindrical connector portion 30 of the connector element 10. Further, the diameter $D_3$ of the elongate body 40 is identical to a diameter of the cylindrical connector openings 250 formed in the second type construction element 200.

The first end 41 of the elongate body 40' of the second cylindrical connector portion 40 is connected to the first cylindrical connector portion 30, in some embodiments via an intermediary portion 50, as mentioned above.

The intermediary portion 50 comprises a first end 51 and a second end 52 and an elongate body 50' extending there between. The intermediary portion 50 has a length $L_5$. The first end 51 of the intermediary portion 50 connects to the first cylindrical connector portion 30. The second end 52 of the intermediary portion 50 connects to the first end 41 of the second cylindrical connector portion 40. The intermediary portion 50 is preferably cylindrical in shape, having an outer diameter $D_5$. The intermediary portion 50 has an outer surface 54.

The elongate body 40' is cylindrical having an elongate axis identical to the elongate of the longitudinal axis $A_1$ of the connector element 10 (see FIG. 8). The elongate body 50' has a diameter, $D_5$, see FIG. 8. Preferably, the diameter $D_5$ of the elongate body 40' of the intermediary portion 50, is smaller than the outer diameter $D_2$ of the first cylindrical connector portion 30 of the connector element 10 and larger than that of the diameter $D_3$ of the elongate body 40' of the second cylindrical connector portion 40.

The snap connection between a second cylindrical connector portion 40 and a cylindrical connector opening 250 is provided by the second cylindrical connector portion 40 being provided with a circumferentially arranged bead 44 arranged at the free end, second end 42 of the second cylindrical connector portion 40, and by a resilience of the second cylindrical connector portion 40. The second end 42 of the second cylindrical connector portion 40 coincides with the second end 22 of the connector element 10 or at the extreme of the second end 22.

The resilience of the second cylindrical connector portion 40 may be provided by one or more slits 45 formed in the longitudinal direction of the second cylindrical connector portion 40. In all of the shown embodiments there are two such slits 45. It will however be appreciated that in other—not shown embodiments—there may be only one slit or there may be three or four slits. Further, it will be appreciated that resilience may alternatively or additionally be provided by a suitable choice of materials. The diameter of the bead 44 is slightly larger than the diameter of the main body of the cylindrical connector portion 240.

A length $L_3$ of the second cylindrical connector portion 40 of the connector element 10 corresponds to a length of the cylindrical connector openings 250. The diameter $D_3$ of the second cylindrical connector portion 40 corresponds to a dimeter of the cylindrical connector openings 250.

Like explained above, each end of the cylindrical connector openings 250 is provided with an enlarged diameter ring-shaped opening (not shown) configured to cooperate with the bead 44 formed on the second cylindrical connector portion 240.

When a second cylindrical connector portion 40 is pressed through a cylindrical connector openings 250 by a user, the resilience of the second cylindrical connector portion 40 allows the bead 244 to be pressed through the main portion of the cylindrical connector opening 250, and when the bead 44 reaches the enlarged diameter ring-shaped opening at the opposite end of the cylindrical connector opening 250, the resilience of the elongate body 40' of the second cylindrical connector portion 40 allows the bead 44 to engage with the enlarged diameter ring-shaped opening, thereby forming a snap connection between the second cylindrical connector portion 40 and the cylindrical connector opening 250.

In the left hand side of FIG. 5 it is illustrated how a second cylindrical connector portion 40/resilient connector peg 270 is inserted into one of the cylindrical connector openings 250 formed in the second type construction element 204, which is provided as an electrical motor having such cylindrical connector openings 250 allowing also connection to other second type construction elements 200 such as the beam 202 and the frame 203 shown in FIG. 2B for example using a second type construction element, such as the construction element 201, shown in FIGS. 2A-B. The left hand side of FIG. 5 also shows how three other connector elements 10 have already been attached to cylindrical connector openings 250 of the electrical motor 204. This allows the attachment of the motor 204 to the plate 104, as illustrated in the right hand side of FIG. 5.

FIGS. 7A and 7B illustrates how a second type construction element 200, such as the electrical motor also shown in FIG. 5 may be connected to a first type construction element 100, such as the plate-shaped construction element 104 also shown in FIG. 5 (with the 8×8 lattice of connector knobs 150) in two different positions relative to the connector knobs 150 of the plate 104.

In FIG. 7A, the electrical motor 204 is attached to the plate 104, by each of the first cylindrical connector portions 30 of the connector elements 10 being connected between four neighbouring connector knobs 150 on the plate 104. This also corresponds to the left hand side of FIG. 6.

FIGS. 7A and 7B also shows a another structure formed on the plate 104, the structure being formed by construction elements 100 in the form of bricks 105 having four connector knobs 150 formed in a 1×4 lattice (and 4 knob-receiving openings 160 (not shown), also arranged in a 1×4 lattice on the opposite side of the brick 105), and bricks 106 having three connector knobs 150 formed in a 1×3 lattice (and 3 knob-receiving openings 160 (not shown), also arranged in a 1×3 lattice on the opposite side of the brick 106). The brick structure forms an angled wall.

From FIG. 7A it will be appreciated that the connector element 10 allows the motor 204 to be connected to the plate 104 in a distance of only half a distance between two connector knobs 150 to the brick structure.

In FIG. 7B the electrical motor 204 is attached to the plate 104, by each of the first cylindrical connector portions 30 of the connector elements 10 being connected over a single connector knob 150 of the plate 104. In this position relative to the connector knobs 150, the motor may be attached to the plate such that motor 204 abuts on the brick structure 105, 106, as shown, or with a distance being a multiple of the distance between two knobs connector 150.

The electrical motor 204 shown in FIGS. 5 and 7A-B has a power outtake in the form of a power outtake part 291 which is rotatably arranged relative to the housing of the electrical motor 204. The power outtake part 290 has an axle receiving opening 291 formed therein and configured for receiving an axle, such as an axle 205 as shown in FIG. 2B. Such an axle may, at it's other—free—end be connected to another constructions element, for example a cogwheel or the like.

The power outtake part 290 of the electrical motor 204 is formed in one surface of the electrical motor 204, here a top surface. From the left hand side of FIG. 5 it may be appreciated that a bottom surface (the surface opposite to the surface wherein the power outtake part 290 is formed), comprises four connector openings 250, such as described above, arranged in a rectangular array. In the left hand side of FIG. 5, four connector elements 10 are shown being placed in the complementary connector openings 250 of the rectangular array of connector openings 250. The right hand side of FIG. 5 shows how the electrical motor 204 may be connected to a plate shaped first type construction element 104, by use of the four connector elements 10. Thereby, a very stable connection of the electrical motor 204 to the plate shaped first type construction element 104 is achieved.

It will be appreciated that the four connector openings 250 arranged in the rectangular array in the bottom surface are further spaced apart by distances complying with the nxm array of the first type construction elements 100.

As shown in FIG. 5 the bottom surface may comprise more than four connector openings 250.

As further shown in FIG. 5, a second type construction element 200, such as the electrical motor 204, may comprise connector openings 250 arranged in other surfaces. For example, the top surface with the power take out part 290 shows two connector openings 250 formed at an end of the electrical motor 204.

However, it will be appreciated that a second type construction element 200, such as the electrical motor 204, as shown in FIG. 5 may comprise connector openings 250 in at least one side surface, such as four connector openings 250 arranged in a rectangular or square lattice formation. Although, not sown it will be appreciated that the not shown opposite surface may also comprise connector openings 25, e.g. similar to the shown bottom surface.

Further, it will be appreciated that the end surfaces of the electrical motor 204 may also comprise connector openings 250.

It will be appreciated that the connector openings 250 in other surfaces will allow mounting of the motor to a plate shaped first type construction element 100, 104 or to other first type construction element 100, via connector elements 10, or to second type construction elements 200, for example using a construction element 201 as shown in FIG. 2A.

The inner surface 33 of the first cylindrical connector portion 30 of the connector element 10 has a length $L_1$, see the sectional view at the right side of FIG. 8.

To allow the connector element 10 to engage in the infringement fit with a connector knob 150 as described above, the length $L_1$ of the inner wall must be larger than a height of a connector knob 150, such that the entire knob may be received within the cavity 30' defined by the inner surface 33.

However, in one embodiment, the length $L_1$ of the inner surface 33 is exactly the same as (equal to) the height of the connector knobs 150 formed on a first type construction element 100. The length $L_1$ of the inner surface 33 may be confined by an internal structure. Such an internal structure may be a ledge (not shown) between the first cylindrical connector portion 30 and the second cylindrical section 40 of the connector element 10 (in embodiments where the two are directly connected to each other) or a ledge (not shown) between the first cylindrical connector portion 30 and the intermediary portion 50 (in embodiments where the connector element 10 also comprises an intermediary portion 50). In yet other embodiments, and as shown in FIG. 8 such an internal structure may be support arms 90 stretching across an inner space of the connector element 10. These support arms 90 may provide structural stability to the connector element 10.

The length of the inner surface 33 of the first cylindrical portion 30 being confined to the height of a connector knob 150, allows for easier detachment of a connector element 10 from a first type construction element 100 in situations, where the connector element has been connected over a connector knob as shown in the right side of FIG. 6. This is because the internal structure abuts on the top surface of the connecter knob 150 and provides a lift there against if the connector element 10 is tilted relative to the connector knob 150.

In not shown embodiments—where the connector element 10 does not comprise an intermediary portion 50—the length $L_2$ of the outer surface 34 of the first cylindrical portion 30 may exceed the height of a connector knob 150. In such embodiments the length $L_2$ of the outer surface 34 of the first cylindrical portion 30 may be 1.5-3×the height of a connector knob. In this case elongate indentations (also not shown) may be provided in the outer surface 34 of the first cylindrical portion 30, the elongate indentations extending perpendicular to the elongate axis $A_1$ of the connector element 10. This would allow a user to grab the connector element 10 by inserting her/his nails in the elongate indentations and pulling the connector element 10, when a connector element 10 is to be detached from a construction elements of the first type 100, especially in situations, where the connector element has been attached between four connector knobs 150 as illustrated in the left side of FIG. 6. One, two, three or four such elongate indentations may be provided along the circumference of the outer surface 34 of the first cylindrical portion 30. A disadvantage of this embodiment is that as the length of the second cylindrical connector portion 40, $L_3$, is fixed to be equal the length of the second cylindrical connecter opening of the second type construction element 200, the overall length, $L_T$ of the connector element becomes longer.

In other, not shown, embodiments—where the connector element 10 also does not comprise an intermediary portion 50—a length $L_2$ of the outer surface 34 of the first cylindrical portion 30 may be equal to height of a connector knob 150. In such cases elongate indentations as described immediately above may be provided (not shown, either) in the second cylindrical connector element 40 for example adjacent to the first end 41 of the body 40' thereof. One, two, three or four such elongate indentations may be provided along the circumference of the outer surface of the second cylindrical connector element 40. A disadvantage of this embodiment is that a thickness body 40' of second cylindrical connector element 40 must be kept low in order to provided the above described resilience, and providing the indentions would risk providing weakening zones in the second cylindrical connector element 40.

In a preferred embodiment, and as shown in FIGS. 3, 4 and 8, the connector element 10 has an intermediary portion 50. The intermediary portion 50 has a diameter $D_5$, which is smaller than the diameter $D_2$ of the outer surface 34 of the first cylindrical connector portion 30 of the connector element 10. In such embodiments, preferably the length $L_2$ of the outer surface 34 of the first cylindrical portion 30 is smaller than a height of a connector knob 150 formed on a first type construction element 100. Thereby, detachment of a connector element 10 from a first type construction element 100, especially when attached between four connector knobs 150 as shown in the left side of FIG. 6 may be achieved, because the connector element may be more easily be tilted relative to the connector knobs.

In a preferred embodiment, and as shown in FIGS. 3, 4 and 8, the connector element 10 has an intermediary portion 50, and this intermediary portion 50 is provided with elongate second indentations 55 formed in the outer surface 54 of the intermediary portion 50 for the same purpose of allowing a user to grab the connector element using hers/his nails to be detached from a construction elements of the first type 100, especially in situations, where the connector element 10 has been attached between four connector knobs 150 as illustrated in the left side of FIG. 6. The elongate second indentations 55 extend perpendicular to the elongate axis $A_1$ of the connector element 10 in the outer surface 54 of the intermediary portion 50. One, two, three or four such elongate second indentations 55 may be provided along the circumference of the outer surface 54 of the first cylindrical portion 30.

In a particularly preferred embodiment, and as shown in FIGS. 3, 4 and 8, the intermediary both comprise elongate second indentations 55 and the length $L_2$ of the outer surface 34 of the first cylindrical portion 30 is smaller than a height of a connector knob 150 formed on a first type construction element 100 (while the intermediary portion 50 has a diameter $D_5$, which is smaller than the diameter $D_2$ of the outer surface 34 of the first cylindrical connector portion 30 of the connector element 10). This allows the above advantages of grabbing the elongate second indentations 55 by the nails, and tilting (due to the deduced length $L_2$ of the outer surface 34 of the first cylindrical connector portion 30), and additionally allows a reduction of an overall length $L_T$ of the connector element 10, because the second elongate indentations 55 may be provided immediately above the top surfaces of the connector knobs (when attached), while the second elongate indentations 55 may be provided in a thick material to maintain the structural stability of the connector element 10.

In preferred embodiments, the connector element 10 is formed in plastic. In further embodiments, the connector element 10 is formed in an injection moulding process.

It is to be noted that the figures and the above description have shown the example embodiments in a simple and schematic manner. Many of the specific mechanical details have not been shown since the person skilled in the art should be familiar with these details and they would just unnecessarily complicate this description. For example, the specific materials used and the specific injection moulding procedure have not been described in detail since it is maintained that the person skilled in the art would be able to find suitable materials and suitable processes to manufacture the connector element according to the current invention.

LIST OF PARTS

1 construction system
10 connector element
20 elongate body of connector element
21 first end of connector element/of elongate body of connector element
22 second end of connector element/of elongate body of connector element
30 first cylindrical connector portion of connector element
33 inner surface of first cylindrical connector portion of connector element
34 outer surface of first cylindrical connector portion of connector element
35 indentation formed in the outer surface of the first cylindrical connector portion of the connector element
40 second cylindrical connector portion of the connector element
40' elongate body of the second cylindrical connector portion of the connector element
41 first end of the second cylindrical connector portion of the connector element
42 second end of the second cylindrical connector portion of the connector element
43 outer surface of the of the second cylindrical connector portion of the connector element
44 circumferential bead formed at the extreme of the second end of the connector element/of elongate body of connector element
45 slit arranged in the longitudinal direction of the connector element
50 intermediary portion of the connector element formed between the first cylindrical connector portion and the second cylindrical connector portion
50' body of the intermediary portion
51 first end 51 of the intermediary portion
second end 52 of the intermediary portion and an elongate body 50'
54 outer surface of the intermediary portion of the connector element
55 second indentation formed in outer surface of the intermediary portion of the connector element
90 support arms
100 first type of construction elements
101 construction element of the first type of construction elements
102 construction element first type of construction elements (brick)
103 construction element first type of construction elements (plate)
110 cylindrical body (of construction element shown in FIG. 1B)
111 first end of cylindrical body of construction element
112 second end of cylindrical body of construction element
130 cylindrical connector portion (of construction element shown in FIG. 1B)
130' cylindrical wall 130' of cylindrical connector portion (of construction element shown in FIG. 1B)
131 first end of cylindrical connector portion/cylindrical wall
132 second end of cylindrical connector portion/cylindrical wall
133 inner surface of the cylindrical wall of the cylindrical connector portion
134 outer surface of the cylindrical wall of the cylindrical connector portion
150 connector knob
151 first end of a connector knob
152 second end of a connector knob
160 knob receiving opening
200 second type of construction element
201 (prior art) construction element of the second type of construction elements
202 (prior art) construction element of the second type of construction elements/beam
203 (prior art) construction element of the second type of construction elements/frame
204 construction element of the second type of construction elements/electrical motor
205 (prior art) construction element/axle
240 (prior art) cylindrical connector portion
250 connector openings
270 resilient connector pegs
290 power outtake part of construction element of the second type of construction elements/electrical motor
291 axle receiving opening of power outtake part
1000 first type construction system
2000 second type construction system
$A_1$ longitudinal axis of connector element/of elongate body of connector element
D length of the connector opening of the second type of construction elements
$D_1$ diameter of the inner surface of the first cylindrical connector portion
$D_2$ diameter of the outer surface of the first cylindrical connector portion
$D_3$ diameter of the elongate body 40 of the second cylindrical connector portion of the connector element
$D_4$ diameter of the inner surface of the second cylindrical connector portion of the connector element
$D_5$ diameter of the outer surface of the intermediary portion/outer diameter of the intermediary portion
$L_1$ length of the inner surface of the first cylindrical connector portion
$L_2$ length of the outer surface of the first cylindrical connector portion
$L_3$ length of the second cylindrical connector portion of the connector element
$L_5$ length of the intermediary portion
$L_T$ overall length/total length of the connector element

What is claimed is:

1. A construction system comprising:

a connector element having an elongate body, the elongate body comprising a first end, an opposite second end, and a longitudinal axis, the first end forming an open first cylindrical connector portion having an inner surface and an outer surface, the opposite second end forming a second cylindrical connector portion;

a first type of construction element having connector knobs formed on a surface thereof, the connector knobs being arranged in a uniform two-dimensional lattice; and a second type of construction element having:

at least one cylindrical connector opening configured for cooperating with the second cylindrical connector portion of the connector element to form a snap connection;

an electrical motor having a box-shaped housing;

a power out-take part formed in a first surface of the box-shaped housing; and three or more connector holes provided in a second surface of the box-shaped housing, wherein each of the three or more connector holes are provided in positons on the second surface at distances from each other corresponding to positions of lattice positions of the uniform two-dimensional lattice of the first type of construction element;

wherein:

the inner surface of the open first cylindrical connector portion is dimensioned to form a friction fit with a connector knob of the first type of construction element when pressed over the connector knob, and the outer surface of the open first cylindrical connector portion is dimensioned to form a friction fit in a space between four adjacent connector knobs formed on the first type construction element.

2. The construction system according to claim 1, wherein the second cylindrical connector portion comprises a circumferential bead formed at an extreme of the opposite second end.

3. The construction system according to claim 1, wherein the second cylindrical connector portion of the connector element comprises a slit arranged in the longitudinal direction of the connector element.

4. The construction system according to claim 1, wherein the outer surface of the open first cylindrical connector portion of the connector element comprises four indentations equidistantly spaced along a perimeter of the outer surface, each of the four indentations being configured to receive a portion of four adjacent connector knobs formed on the first type construction element.

5. The construction system according to claim 1, wherein a length of the inner surface of the open first cylindrical connector portion of the connector element is equal to a height of the connector knobs formed on the first type construction element.

6. The construction system according to claim 1, wherein the connector element further comprises an intermediary portion between the open first cylindrical connector portion and the second cylindrical connector portion, the intermediary portion having elongate second indentations formed in an outer surface of the intermediary portion, the elongate second indentations perpendicular to the longitudinal axis of the connector element.

7. The construction system according to claim 6, wherein a length of the outer wall of the open first cylindrical connector portion is shorter than a height of a connector knob formed on the first type construction element.

8. The construction system according to claim 1, wherein a length of the second cylindrical connector portion of the connector element is equal to a length of the cylindrical connector opening of the second type of construction element.

9. A construction system comprising:

a connector element having an elongate body, the elongate body comprising a first end, an opposite second end, and a longitudinal axis, the first end forming an open first cylindrical connector portion having an inner surface and an outer surface, the opposite second end forming a second cylindrical connector portion;

a first type of construction element having connector knobs formed on a surface thereof, the connector knobs being arranged in a uniform two-dimensional lattice; and a second type of construction element having at least one cylindrical connector opening configured for cooperating with the second cylindrical connector portion of the connector element to form a snap connection, wherein:

the inner surface of the open first cylindrical connector portion is dimensioned to form a friction fit with a connector knob of the first type of construction element when pressed over the connector knob, the outer surface of the open first cylindrical connector portion is dimensioned to form a friction fit in a space between four adjacent connector knobs formed on the first type construction element, and the outer surface of the open first cylindrical connector portion comprises four indentations equidistantly spaced along a perimeter of the outer surface, each of the four indentations being configured to receive a portion of four adjacent connector knobs formed on the first type construction element.

10. The construction system according to claim 9, wherein the second cylindrical connector portion comprises a circumferential bead formed at an extreme of the opposite second end.

11. The construction system according to claim 9, wherein the second cylindrical connector portion of the connector element comprises a slit arranged in the longitudinal direction of the connector element.

12. The construction system according to claim 9, wherein a length of the inner surface of the open first cylindrical connector portion of the connector element is equal to a height of the connector knobs formed on the first type construction element.

13. The construction system according to claim 9, wherein the connector element further comprises an intermediary portion between the open first cylindrical connector portion and the second cylindrical connector portion, the intermediary portion having elongate second indentations formed m an outer surface of the intermediary portion, the elongate second indentations perpendicular to the longitudinal axis of the connector element.

14. The construction system according to claim 13, wherein a length of the outer wall of the open first cylindrical connector portion is shorter than a height of a connector knob formed on the first type construction element.

15. The construction system according to claim 9, wherein a length of the second cylindrical connector portion of the connector element is equal to a length of the cylindrical connector opening of the second type of construction element.

* * * * *